US009688073B2

(12) United States Patent
Masuo

(10) Patent No.: US 9,688,073 B2
(45) Date of Patent: Jun. 27, 2017

(54) LIQUID SUPPLY DEVICE AND IMAGE FORMING APPARATUS

(71) Applicant: FUJIFILM Corporation, Tokyo (JP)

(72) Inventor: Tsutomu Masuo, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/992,610

(22) Filed: Jan. 11, 2016

(65) Prior Publication Data

US 2016/0257123 A1 Sep. 8, 2016

(30) Foreign Application Priority Data

Mar. 3, 2015 (JP) ..... 2015-041790

(51) Int. Cl.
*G03G 15/08* (2006.01)
*G03G 15/10* (2006.01)
*B41J 2/175* (2006.01)

(52) U.S. Cl.
CPC ..... *B41J 2/175* (2013.01); *G03G 15/0849* (2013.01); *G03G 15/0851* (2013.01); *G03G 15/105* (2013.01)

(58) Field of Classification Search
CPC . B41J 2/175; G03G 15/0849; G03G 15/0851; G03G 15/105
See application file for complete search history.

(56) References Cited

U.S. PATENT DOCUMENTS 4,008,612 A * 2/1977 Nagaoka ..... G01F 23/0007 340/619
4,671,309 A * 6/1987 Iemura ..... G03G 15/105 118/691
5,950,643 A * 9/1999 Miyazaki ..... B28D 5/0076 134/201
6,011,943 A * 1/2000 Kim ..... G03G 15/104 399/237
6,377,760 B1 * 4/2002 Hagiwara ..... G03G 15/105 399/30
6,411,790 B1 * 6/2002 Kim ..... G03G 15/104 399/233
6,694,113 B2 * 2/2004 Park ..... G03G 15/105 399/57
8,039,059 B2 * 10/2011 Ishihara ..... B41J 2/175 427/426

FOREIGN PATENT DOCUMENTS

JP 2012-125724 A 7/2012

* cited by examiner

*Primary Examiner* — Anh T. N. Vo
(74) *Attorney, Agent, or Firm* — Studebaker & Brackett PC

(57) ABSTRACT

A liquid supply device and an image forming apparatus in which the maintenance of a concentration detecting device is improved are obtained. The liquid supply device includes a flow passage through which liquid to be imparted to paper flows; a case including an inlet that is fixed to the flow passage and introduces a liquid from the flow passage, and an outlet that leads the liquid out to the flow passage; and a concentration detecting device that is openably and closably or attachably and detachably attached to the case and includes a detection unit, which detects the concentration of the liquid, at a position that faces the case.

14 Claims, 9 Drawing Sheets

LIQUID SUPPLY DEVICE AND IMAGE FORMING APPARATUS

CROSS-REFERENCE TO RELATED APPLICATIONS

The present application claims priority under 35 U.S.C. §119 to Japanese Patent Application No. 2015-041790, filed on Mar. 3, 2015. The above application(s) is hereby expressly incorporated by reference, in its entirety, into the present application.

BACKGROUND OF THE INVENTION

1. Field of the Invention

The present invention relates to a liquid supply device and an image forming apparatus.

2. Description of the Related Art

JP2012-125724A discloses a structure in which a concentration meter (concentration detecting device) is attached to an application liquid supply passage (flow passage) through which process liquid (liquid) for being imparted to paper is supplied to an application pan. Here, the concentration meter is provided with a detection unit that detects the concentration of the process liquid, and the concentration meter is fixed to the application liquid supply passage in a state where the detection unit is inserted into the application liquid supply passage.

SUMMARY OF THE INVENTION

Meanwhile, in a concentration detecting device, such as a concentration meter, the detection unit may be periodically cleaned in order to maintain detection accuracy. However, in the structure in which the concentration detecting device is fixed to the flow passage, it is necessary to detach parts on the flow passage side in order to clean the detection unit. Therefore, work is complicated. For this reason, there is room for improvement from the viewpoint of improving the maintenance of the concentration detecting device.

The invention has been made in consideration of the above fact, and an object thereof is to obtain a liquid supply device and an image forming apparatus in which the maintenance of a concentration detecting device can be improved.

In order to solve the above problems, a liquid supply device related to a first aspect of the invention is a liquid supply device comprising a flow passage through which liquid for being imparted to paper flows; a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case.

According to the liquid supply device related to the first aspect of the invention, the case is fixed to the flow passage through which the liquid flows, and the case includes the inlet and the outlet. Additionally, the concentration detecting device is attached to the case, and the detection unit that detects the concentration of the liquid is provided at the position of the concentration detecting device that faces the case. Here, the concentration detecting device is openably and closably or attachably and detachably attached to the case. For this reason, the detection unit can be exposed simply by opening and closing or attaching and detaching the concentration detecting device with respect to the case. That is, the maintenance of the concentration detecting device can be improved. In addition, the expression "attachable and detachable" herein means that the concentration detecting device is capable of being detached from the case or attached to the case without a worker using a tool or the like.

In the liquid supply device related to a second aspect of the invention based on the liquid supply device related to the first aspect, the concentration detecting device is openably and closably coupled to the case with a hinge.

According to the liquid supply device related to the second aspect of the invention, the detection unit can be exposed by opening the concentration detecting device with respect to the case. For this reason, the detection unit can be cleaned without detaching the concentration detecting device from the case. Additionally, since the concentration detecting device only has to be closed to the case side after the cleaning of the detection unit. Substantial time and effort are not taken.

In the liquid supply device related to a third aspect of the invention based on the liquid supply device related to the first aspect or the second aspect, the concentration detecting device is provided with a mounting part for mounting a liquid tank for storing liquid for calibration, at a position that faces the detection unit.

According to the liquid supply device related to the third aspect of the invention, man hours required for the calibration of the concentration detecting device can be reduced. That is, in the case where the calibration is performed by pouring the liquid for calibration into the flow passage, it is necessary to pour the liquid for calibration into the flow passage after the liquid for being imparted to paper is discarded. Additionally, after the calibration is carried out, it is necessary to discard the liquid for calibration and to pour the liquid for being imparted to paper again, and substantial time and effort are required. In contrast, in the configuration in which the concentration detecting device is provided with the mounting part for mounting the liquid tank, the calibration can be performed simply by mounting the liquid tank on the concentration detecting device and storing the liquid for calibration in this liquid tank. For this reason, the man hours required for the calibration can be reduced. That is, the maintenance of the concentration detecting device can be improved. Additionally, since it is not necessary to discard the liquid within the flow passage at the time of the calibration, cost can be reduced.

In the liquid supply device related to a fourth aspect of the invention based on the liquid supply device related to the third aspect, a liquid tank supporting member, which is movable between a calibration position and a standby position, is attached to the concentration detecting device, and the liquid tank is attached to the liquid tank supporting member and faces the detection unit at the calibration position.

According to the liquid supply device related to the fourth aspect of the invention, the liquid tank can be attached at the position that faces the detection unit simply by moving the liquid tank supporting member from a standby position to a calibration position. Accordingly, the man hours required for the calibration can be reduced. Additionally, since the liquid tank is attached to the concentration detecting device via the liquid tank supporting member, it is not necessary to separately secure a space for placing the liquid tank around the concentration detecting device.

In the liquid supply device related to a fifth aspect of the invention based on the liquid supply device related to the third aspect or the fourth aspect, the liquid tank is provided with a liquid-tank-side seal member that seals between the liquid tank and the concentration detecting device.

According to the liquid supply device related to the fifth aspect of the invention, a gap between the concentration detecting device and the liquid tank is sealed with the seal member, so that the liquid for calibration stored in the liquid tank can be prevented from leaking.

In the liquid supply device related to a sixth aspect of the invention based on the liquid supply device related to any one aspect of the first aspect to the fifth aspect, the case is provided with a case-side seal member that seals between the case and the concentration detecting device.

According to the liquid supply device related to the sixth aspect of the invention, a gap between the concentration detecting device and the case is sealed, so that the liquid introduced between the case and the concentration detecting device can be prevented from leaking from the flow passage.

In the liquid supply device related to a seventh aspect of the invention based on the liquid supply device related to any one aspect of the first aspect to the sixth aspect, the concentration detecting device is provided with a roof part that covers at least a upper side of the detection unit.

According to the liquid supply device related to the seventh aspect of the invention, even in a case where the liquid has leaked from the flow passage disposed on the device upper side of the concentration detecting device, this liquid can be prevented from adhering to the detection unit. As a result, excellent detection accuracy of the concentration detecting device can be maintained.

In the liquid supply device related to an eighth aspect of the invention based on the liquid supply device related to the seventh aspect, the roof part extends to a position where an upper part of the case is covered in a state where the concentration detecting device is attached to the case.

According to the liquid supply device related to the eighth aspect of the invention, even in a case where the liquid has leaked from the flow passage disposed on the device upper side of the case, this liquid can be prevented from adhering to the case.

In the liquid supply device related to a ninth aspect of the invention based on the liquid supply device related to any one aspect of the first aspect to the eighth aspect, the concentration detecting device includes a device body, a power cable that is connected to the device body, and a cover that covers a connecting part between the device body and the power cable.

According to the liquid supply device related to the ninth aspect of the invention, the connecting part between the device body and the power cable is covered with the cover. Accordingly, even in a case where the liquid flowing through the flow passage has leaked, the liquid can be prevented from adhering to the connecting part.

In the liquid supply device related to a tenth aspect of the invention based on the liquid supply device related to the ninth aspect, the power cable is covered with a protecting member.

According to the liquid supply device related to the tenth aspect of the invention, the protecting member can protect the power cable from the liquid.

In the liquid supply device related to an eleventh aspect of the invention based on the liquid supply device related to the ninth aspect or the tenth aspect, the power cable extends from the connecting part to a lower side of the device body, and is disposed in a substantial U-shape so as to be bent on the lower side below the cover.

According to the liquid supply device related to the eleventh aspect of the invention, in the case where the liquid has adhered to the protecting member, this liquid flows to the bent portion on the device lower side below the cover along the power cable. Accordingly, the liquid adhering to the power cable can be prevented from influencing the connecting part between the device body and the power cable.

In the liquid supply device related to a twelfth aspect of the invention based on the liquid supply device related to any one aspect of the first aspect to the eleventh aspect, the case is attached to and unitized with a frame member.

According to the liquid supply device related to the twelfth aspect of the invention, the workability between the case and the flow passage can be improved by performing unitization.

In the liquid supply device related to a thirteenth aspect of the invention based on the liquid supply device related to any one aspect of the first aspect to the twelfth aspect, the case is supported by a plurality of rod bodies provided to protrude from the frame member.

According to the liquid supply device related to the thirteenth aspect of the invention, the flow passage can be disposed between the plurality of rod bodies. Accordingly, in contrast to a structure in which the case is supported by a plate-like member, the space between the case and the frame member can be more effectively utilized.

An image forming apparatus related to a fourteenth aspect of the invention includes the liquid supply device related to any one aspect of the first aspect to the thirteenth aspect; a liquid imparting unit that imparts a liquid containing a flocculant to paper; a discharge head including a plurality of nozzles that discharge droplets to the paper to which the liquid has been imparted; and a transporting member that transports the paper between the liquid imparting unit and the discharge head.

According to the image forming apparatus related to the fourteenth aspect of the invention, after the liquid containing the flocculant is imparted to paper by the liquid imparting unit, an image is formed by discharging droplets from the discharge head to this paper. Accordingly, a coloring material in ink (pigment) can be flocculated. Additionally, since the concentration detecting device that constitutes the liquid supply device of the liquid imparting unit is openably and closably or attachably and detachably attached to the case, maintenance can be improved.

As described above, in the liquid supply device and the image forming apparatus related to the invention, the maintenance of the concentration detecting device can be improved.

DESCRIPTION OF THE PREFERRED EMBODIMENTS

Figure 1:
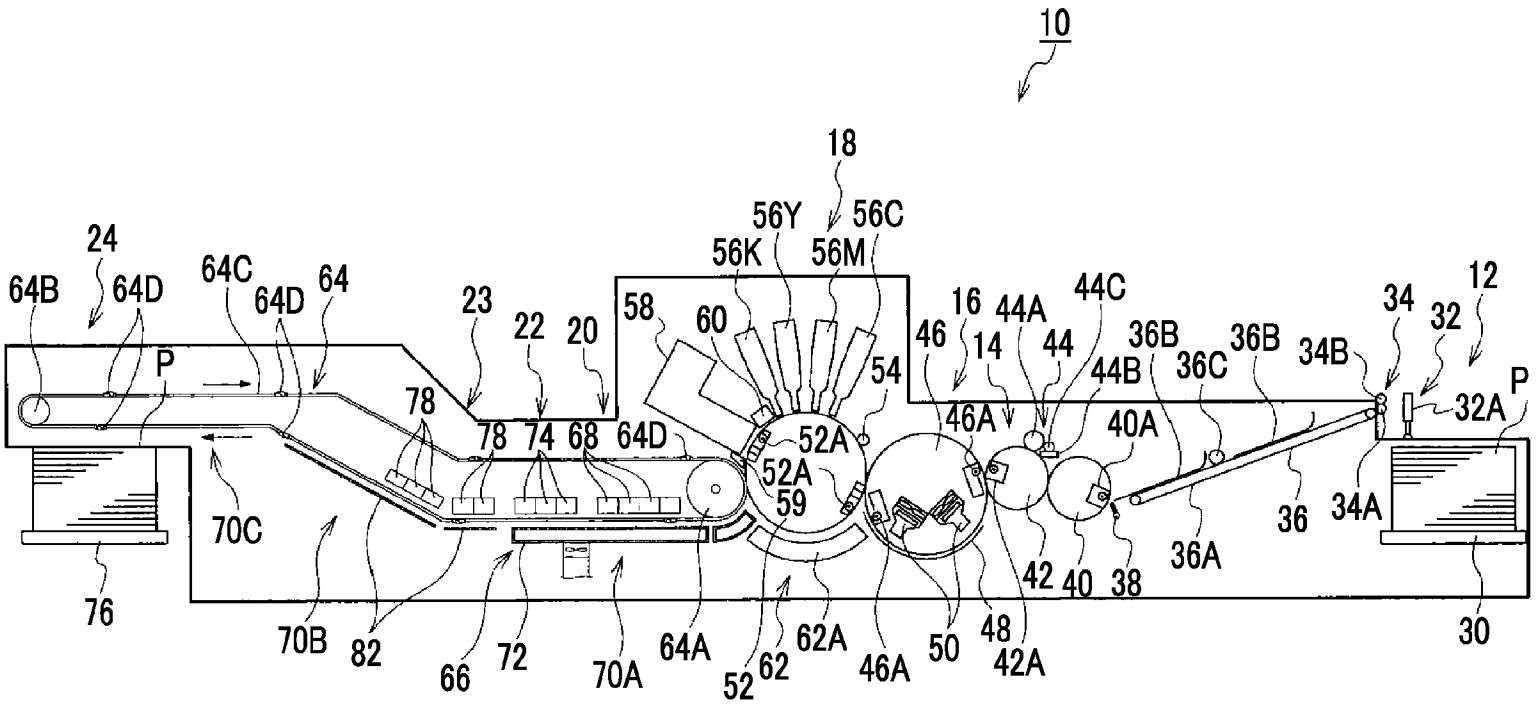
FIG. 1 is an overall configuration view of an image forming apparatus related to an embodiment.

Hereinafter, an embodiment related to the invention will be described, referring to the attached drawings. In the present embodiment, an example in which the invention is applied to an image forming apparatus for which water-based pigment ink is used will be described. In addition, in the drawings, constituent elements that have the same functions will be designated by the same reference signs, and the description thereof will be appropriately omitted.

(Overall Configuration of Image Forming Apparatus)

As illustrated in FIG. 1, an image forming apparatus 10 related to the present embodiment is configured to record an image on a sheet of paper P by an ink jet method, using water-based pigment ink. The image forming apparatus 10 is configured to include a paper feeding section 12 that feeds paper P, transporting means that transports the paper P, a process liquid imparting section 14, a process liquid drying processing section 16, an image forming section 18, a heat-drying processing section 20, an ultraviolet irradiation processing section 22, a cooling processing section 23, a paper ejection section 24 that ejects the paper P, and a control section.

(Paper Feeding Section)

The paper feeding section 12 is configured so as to feed the paper P stacked on a paper feed stand 30 to the process liquid imparting section 14 sheet by sheet. The paper feeding section 12 is configured to include, mainly, the paper feed stand 30, a sucker device 32, a paper feed roller pair 34, a feeder board 36, a front pad 38, and a paper feed drum 40.

The paper P is placed on the paper feed stand 30 in a bundled state where a plurality of sheets are stacked. The paper feed stand 30 is provided so as to be liftable by a paper feed stand ascending and descending device (not illustrated). Additionally, the paper feed stand ascending and descending device is controlled so as to be driven in conjunction with an increase or decrease in the amount of the paper P stacked on the paper feed stand 30. The paper feed stand 30 ascends and descends so that the paper P located at the uppermost position of the bundle is always located at a constant height.

Although the paper P is not particularly limited, general-purpose printing paper (paper having cellulose as a main constituent, such as so-called high-quality paper, coated paper, and art paper) to be used for general offset printing or the like can be used.

The sucker device 32 takes up the paper P stacked on the paper feed stand 30 sheet by sheet sequentially from the top, and feeds the paper to the paper feed roller pair 34. The sucker device 32 includes a suction foot 32A that is provided so as to be liftable and rockable. An upper surface of the paper P is suctioned and held by the suction foot 32A, and the paper P is transported from the paper feed stand 30 to the paper feed roller pair 34. In this case, the suction foot 32A is configured to suction and hold the upper surface on the tip side of the paper P located at the uppermost position of the bundle to pull up the paper P and to insert the tip of the pulled-up paper P between a pair of a roller 34A and a roller 34B that constitute the paper feed roller pair 34.

The paper feed roller pair 34 is constituted of the pair of upper and lower roller 34A and roller 34B that are pressed to abut against each other. A driving roller (for example, the roller 34A) is used as one of the pair of upper and lower roller 34A and roller 34B, and a driven roller (for example, the roller 34B) is used as the other. The driving roller is connected to a motor (not illustrated), and is driven and rotated by the rotation of this motor. The motor is driven in conjunction with feeding of the paper P, and if the paper P is fed from the sucker device 32, the motor rotates the driving roller in accordance with the timing. The paper P inserted between the pair of upper and lower roller 34A and roller 34B is nipped by the roller 34A and the roller 34B, and is delivered in an installation direction of the feeder board 36.

The feeder board 36 is formed to correspond to a paper width, and is configured to guide the paper P delivered from the paper feed roller pair 34 to the front pad 38. The feeder board 36 is installed to incline downward, and the paper P placed on a transporting surface of a transporting path of the feeder board 36 slides along the transporting surface, and is guided to the front pad 38.

A plurality of tape feeders 36A that transport the paper P and have this transporting direction as a longitudinal direction are installed at predetermined intervals in a width direction on the feeder board 36. The tape feeders 36A are formed in an endless form, and are configured to rotate using a motor (not illustrated) as a driving source. The paper P placed on the transporting surface of the feeder board 36 is transported on the feeder board 36 by the tape feeders 36A.

A retainer 36B and a roller 36C are installed on the feeder board 36. A plurality of retainers 36B are longitudinally arranged at the front and back along the transporting surface of the paper P (two retainers are arranged in the present embodiment). The retainers 36B are constituted of flat springs having a width corresponding to the paper width, and are pressed to abut against the transporting surface. Irregularities of the paper P that is transported on the feeder board 36 are corrected by the tape feeder 36A when the paper passes through the retainers 36B. The roller 36C is disposed between the retainer 36B on the upstream side and the retainer 36B on the downstream side that are arranged in the transporting direction. The roller 36C is pressed to abut against the transporting surface of the paper P. Then, the paper P is transported between the retainers 36B while the upper surface thereof is pressed by the roller 36C.

The front pad 38 corrects the posture of the paper P. The front pad 38 is formed in a plate shape, and has a plate-shaped surface arranged to be orthogonal to the transporting direction of the paper P. Additionally, the front pad 38 is connected to a motor (not illustrated), and is driven by this motor so as to be rockable. When the tip of the paper P that has been transported on the feeder board 36 abuts against the front pad 38, the transportation posture of the paper P is corrected (so-called skew prevention is performed). The front pad 38 is rocked in conjunction with the paper feeding of the paper P to the paper feed drum 40, and the paper P of which the transportation posture has been corrected is delivered to the paper feed drum 40.

The paper feed drum 40 receives the paper P that is fed from the feeder board 36 via the front pad 38, and transports the paper to the process liquid imparting section 14. The paper feed drum 40 is formed in a cylindrical shape, is connected to a motor (not illustrated), and is rotated by the driving power of this motor. Additionally, a gripper 40A is provided on an outer peripheral surface of the paper feed drum 40, and the tip of the paper P is gripped by the gripper 40A. By gripping and rotating the tip of the paper P with the gripper 40A, the paper feed drum 40 transports the paper P to the process liquid imparting section 14 while the paper P is wound on the peripheral surface thereof.

(Process Liquid Imparting Section)

The process liquid imparting section 14 imparts a predetermined process liquid to the surface (image formation surface) of the paper P. The process liquid imparting section 14 is configured to include, mainly, a process liquid imparting drum 42 that transports the paper P, and a process liquid imparting unit 44 serving as liquid imparting unit that imparts the predetermined process liquid to the image formation surface of the paper P transported by the process liquid imparting drum 42. The process liquid to be imparted to the surface of the paper P is liquid containing a flocculant that has a function to flocculate a coloring material (pigment) in ink to be discharged (dropped) to the paper P in the image forming section 18 disposed on the downstream side in the transporting direction.

The process liquid imparting drum 42 transports the paper P, which has been transported from the paper feed drum 40 of the paper feeding section 12, to the process liquid drying processing section 16. The process liquid imparting drum 42 is formed in a cylindrical shape, is connected to a motor (not illustrated), and is rotated by the driving power of this motor. A gripper 42A is provided on an outer peripheral surface of the process liquid imparting drum 42, and has a configuration in which the tip of the paper P is gripped by the gripper 42A. By gripping and rotating the tip of the paper P with the gripper 42A, the process liquid imparting drum 42 transports the paper P to the process liquid drying processing section 16 while the paper P is wound on the peripheral surface thereof. If the process liquid imparting drum 42 makes one rotation, one sheet of paper P is transported. The rotation of the process liquid imparting drum 42 and the paper feed drum 40 is controlled such that the timings of reception and delivery of the paper P on the drums are made to coincide with each other. That is, the process liquid imparting drum 42 and the paper feed drum 40 are driven such that the circumferential speeds of both of the drums are made to coincide with each other, and are driven such that the positions of both of the grippers 40A and 42A are made to coincide with each other.

Figure 2:
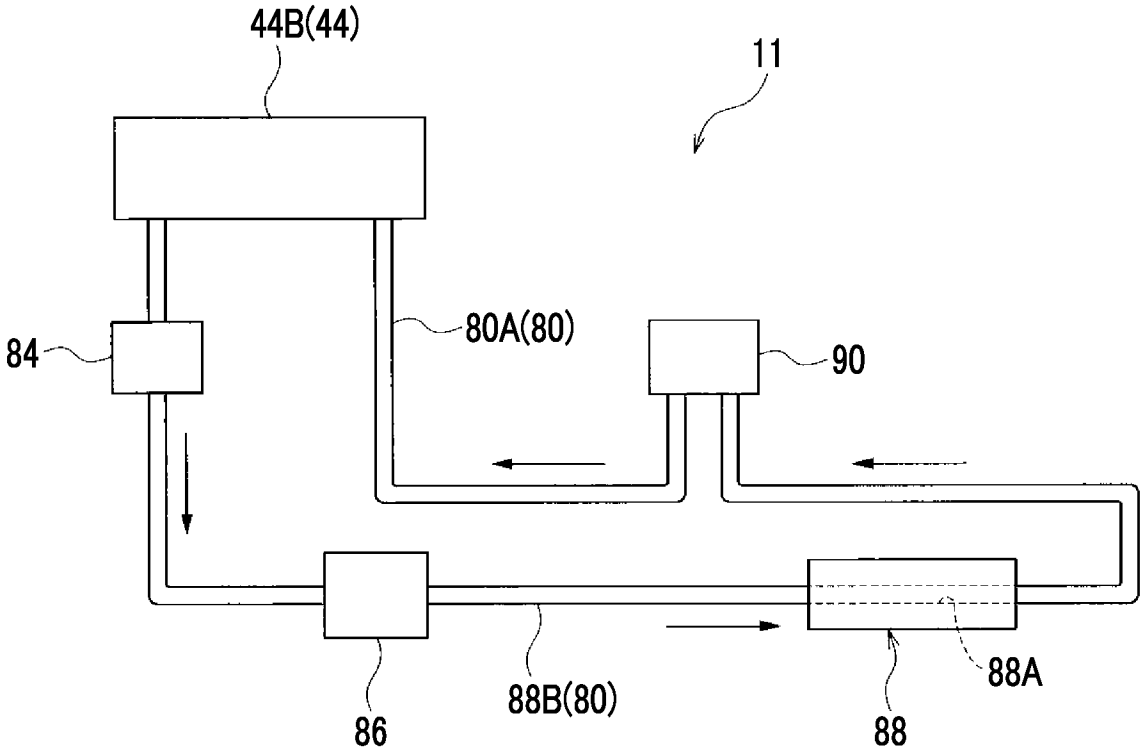
FIG. 2 is a schematic view schematically illustrating a liquid supply device that constitutes the image forming apparatus related to the embodiment.

The process liquid imparting unit 44 applies the process liquid onto the surface of the paper P transported by the process liquid imparting drum 42. The process liquid imparting unit 44 includes, mainly, an application roller 44A that applies the process liquid onto the paper P, a process liquid tank 44B in which the process liquid is stored, and a pumping roller 44C that pumps the process liquid stored in the process liquid tank 44B and supplies the process liquid to the application roller 44A. Here, as illustrated in FIG. 2, a circulatory flow passage (flow passage) 80 that constitutes the liquid supply device 11 is connected to the process liquid tank 44B. The details of the liquid supply device 11 will be described below.

In addition, in the present embodiment, the process liquid is applied by a roller. However, a method of imparting the process liquid is not limited to this. In addition to this a method of applying the process liquid using an inkjet head or a method of applying the process liquid using a spray may be adopted for the application of the process liquid.

(Process Liquid Drying Processing Section)

In the process liquid drying processing section 16, drying processing of the paper P having the process liquid imparted to the surface thereof is performed. The process liquid drying processing section 16 is configured to include, mainly, a process liquid drying processing drum 46 that transports the paper P, a paper transportation guide 48, and a process liquid drying processing section 50 that blows dry air against the image formation surface of the paper P transported by the process liquid drying processing drum 46 serving as a transporting member, and dries the image formation surface.

The process liquid drying processing drum 46 is configured to receive the paper P from the process liquid imparting drum 42 of the process liquid imparting section 14, and transport the paper P to the image forming section 18. The process liquid drying processing drum 46 is constituted of a frame body assembled in a cylindrical shape, is connected to a motor (not illustrated), and is rotated by the driving power of this motor. Additionally, a gripper 46A is provided on an outer peripheral surface of the process liquid drying processing drum 46, and the tip of the paper P is gripped by the gripper 46A. The process liquid drying processing drum 46 transports the paper P to the image forming section 18 when the tip of the paper P is gripped and rotated by the gripper 46A. In addition, the process liquid drying processing drum 46 in the present embodiment has grippers 46A disposed in two places on the outer peripheral surface thereof, and is configured to transport two sheets of paper P through one rotation thereof. The rotation of the process liquid drying processing drum 46 and the process liquid imparting drum 42 is controlled such that the timings of reception and delivery of the paper P on both of the drums are made to coincide with each other. That is, the process liquid drying processing drum 46 and the process liquid imparting drum 42 are driven such that the circumferential speeds of both of the drums are made to coincide with each other, and are driven such that the positions of the gripper 42A and the gripper 46A are made to coincide with each other.

The paper transportation guide 48 is disposed at the outer periphery of the process liquid drying processing drum 46 along the transporting path of the paper P. The paper transportation guide 48 guides the paper P such that it does not become separated from the process liquid drying processing drum 46 (transporting path).

The process liquid drying processing section 50 is installed inside the process liquid drying processing drum 46, and is configured to blow dry air toward the surface of the paper P transported by the process liquid drying processing drum 46 and perform drying processing thereof. Accordingly, a solvent component in the process liquid is removed and an ink flocculation layer is formed on the surface of the paper P. In the present embodiment, two process liquid drying processing sections 50 are disposed within the process liquid drying processing drum, and are configured to blow dry air toward the surface of the paper P transported by the process liquid drying processing drum 46.

(Image Forming Section)

The image forming section 18 is configured to discharge droplets of ink in respective colors of M (magenta), K (black), Y (yellow), and C (cyan) to the image formation surface of the paper P, and record (print or draw) a color image on the image formation surface of the paper P. The image forming section 18 is configured to include, mainly, an image formation drum 52 serving as a transporting member that transports the paper P, a paper presser roller 54 that presses the paper P transported by the image formation drum 52 and brings the paper P into close contact with a peripheral surface of the image formation drum 52, inkjet heads 56K, 56Y, 56M, and 56C (hereinafter referred to as "inkjet heads 56" when being generically named) as examples of discharge heads that discharge ink drops (droplets) in respective colors of M, K, Y, and C to the paper P, an in-line sensor 58 that reads the image recorded on the paper P, a mist filter 60 that traps ink mist, and a drum cooling unit 62.

The image formation drum 52 is configured to receive the paper P from the process liquid drying processing drum 46 of the process liquid drying processing section 16, and transport the paper P to the heat-drying processing section 20. The image formation drum 52 is formed in a cylindrical shape, is connected to a motor (not illustrated), and is rotated by the driving power of this motor. Additionally, a gripper 52A is provided on an outer peripheral surface of the image formation drum 52, and the tip of the paper P is gripped by the gripper 52A. By gripping and rotating the tip of the paper P with the gripper 52A, the image formation drum 52 transports the paper P to the heat-drying processing section 20 while the paper P is wound around the peripheral surface thereof. Additionally, a large number of suction holes (not illustrated) are provided in a predetermined pattern in the peripheral surface of the image formation drum 52. When the paper P wound around the peripheral surface of the image formation drum 52 is suctioned through the suction holes, the paper is made transportable while being suctioned and held by the peripheral surface of the image formation drum 52. Accordingly, the paper P is made transportable with high smoothness.

In addition, suctioning from the suction holes is performed only within a certain range, and the paper P is suctioned from a predetermined suction start position to a predetermined suction end position. The suction start position is set to an installation position of the paper presser roller 54. The suction end position is set to the downstream side of the installation position of the in-line sensor 58, for example, is set to a position where the paper P is delivered to the heat-drying processing section 20. That is, at least at the installation positions (image formation position) of the inkjet heads 56, and the installation position (image reading position) of the in-line sensor 58, the paper P is set so as to be suctioned and held by the peripheral surface of the image formation drum 52. Additionally, the suction method may be a suction method using electrostatic suction without being limited to a suction method using negative pressure.

Additionally, the image formation drum 52 in the present embodiment has grippers 52A disposed in two places on the outer peripheral surface thereof, and is enabled to transport two sheets of paper P through one rotation. The rotation of the image formation drum 52 and the process liquid drying processing drum 46 is controlled such that the timings of reception and delivery of the paper P on both of the drums are made to coincide with each other. That is, the image formation drum 52 and the process liquid drying processing drum 46 are driven such that the circumferential speeds of both of the drums are made to coincide with each other, and are driven such that the positions of both of the grippers 46A and 52A are made to coincide with each other.

The paper presser roller 54 is disposed in the vicinity of the reception position (a position where the paper P is received from the process liquid drying processing drum 46) of the paper P on the image formation drum 52. The paper presser roller 54 is constituted of, for example, a rubber roller, and is installed so as to be pressed and abut against the peripheral surface of the image formation drum 52. The paper P delivered from the process liquid drying processing drum 46 to the image formation drum 52 is nipped when passing via the paper presser roller 54, and is brought into close contact with the peripheral surface of the image formation drum 52.

The four inkjet heads 56K, 56Y, 56M, and 56C are arranged at regular intervals along the transporting path of the paper P on the outer peripheral surface of the image formation drum 52. Each of the inkjet heads 56K, 56Y, 56M, and 56C is constituted of a line head corresponding to the paper width, and has a configuration in which a nozzle surface is arranged to face the peripheral surface of the image formation drum 52. Each of the inkjet heads 56K, 56Y, 56M, and 56C discharges droplets of ink toward the image formation drum 52 from nozzle rows formed in the nozzle surface, thereby forming an image on the paper P transported by the image formation drum 52.

Here, in the present embodiment, as an example, the inkjet heads 56 are configured so as not to discharge ink to the same position of the paper P. That is, the inkjet heads are configured so as not to perform multiple writing. Additionally, the inkjet heads 56 are configured so as to perform image formation through a single path method that forms a one-line image in one scan.

The in-line sensor 58 is installed on the downstream side in the transporting direction of the inkjet head 56K at the tail end. The in-line sensor 58 is configured to read the image recorded by the inkjet heads 56K, 56Y, 56M, and 56C. The in-line sensor 58 is constituted of, for example, a line scanner.

In addition, a contact prevention plate 59 installed in proximity to the in-line sensor 58 is provided on the downstream side of the in-line sensor 58. The contact prevention plate 59 is able to prevent the contact of the paper P with the in-line sensor 58 when rising-up, creasing, or the like has occurred in the paper P due to the malfunction of transportation, or the like.

The mist filter 60 is disposed between the inkjet head 56K at the tail end and the in-line sensor 58, and suctions the air around the image formation drum 52, to trap ink mist. The trapping of ink mist prevents entry of the ink mist into the in-line sensor 58 and effectively prevents occurrence of, for example, poor reading of an image.

The drum cooling unit 62 is configured to blow cold wind against the image formation drum 52 and cool the image formation drum 52. The drum cooling unit 62 is constituted of, mainly, an air-conditioner (not illustrated), and a duct 62A through which the cold wind supplied from the air-conditioner is blown against the peripheral surface of the image formation drum 52. The duct 62A is configured to allow cold wind to be blown against the image formation drum 52 therethrough in regions other than the transportation region of the paper P so as to cool the image formation drum 52. In the present embodiment, the paper P is transported along a circular-arc outer peripheral surface of a substantially upper half of the image formation drum 52. Thus, the duct 62A is adapted to allow cold wind to be blown against a substantially lower half region of the image formation drum 52 therethrough so as to cool the image formation drum 52. Specifically, blow-out ports (not illustrated) of the duct 62A are arranged in a circular-arc shape so as to cover a substantially lower half of the image formation drum 52.

(Heat-Drying Processing Section)

The heat-drying processing section 20 performs drying processing of the paper P after image recording, and removes a liquid component that remains on the surface of the paper P. The heat-drying processing section 20 is configured to include, mainly, a chain gripper 64 serving as an example of transporting means for transporting the paper P on which an image has been recorded, a back tension imparting mechanism 66 that makes a back tension (tension) act on the paper P transported by the chain gripper 64, and a drying unit 68 that heats and dries the paper P transported by the chain gripper 64.

The chain gripper 64 is a paper transporting mechanism that is used in common in the heat-drying processing section 20, the ultraviolet irradiation processing section 22, and the paper ejection section 24, receives the paper P delivered from the image forming section 18, and transports the paper to the paper ejection section 24.

The chain gripper 64 is configured to include, mainly, a first sprocket 64A that is installed in proximity to the image formation drum 52, and a second sprocket 64B that is installed in the paper ejection section 24. Additionally, an endless chain 64C is wound around the first sprocket 64A and the second sprocket 64B. Moreover, a plurality of chain guides (not illustrated) that guide traveling of a chain 64C are provided, and a plurality of grippers 64D are attached to the chain 64C at regular intervals. First sprockets 64A, second sprockets 64B, chains 64C, and chain guides are constituted with there being one pair of each, and are arranged on both sides of the paper P in the width direction. Additionally, the grippers 64D are installed so as to be stretched over the chains 64C that are provided as one pair.

The first sprocket 64A is installed in proximity to the image formation drum 52 so that the paper P delivered from the image formation drum 52 can be received by the grippers 64D. The first sprocket 64A is journalled to a bearing (not illustrated), is rotatably provided, and is coupled to a motor (not illustrated) via a gear. The chains 64C wound around the first sprocket 64A and the second sprocket 64B are made to travel by driving this motor.

The second sprocket 64B is installed in the paper ejection section 24 so that the paper P received from the image formation drum 52 can be collected by the paper ejection section 24. That is, the installation position of the second sprocket 64B is set to a termination end of the transporting path of the paper P due to the chain gripper 64. The second sprocket 64B is journalled to a bearing (not illustrated), and is rotatably provided.

The chain 64C is formed in an endless form, and is wound around the first sprocket 64A and the second sprocket 64B.

The chain guides are arranged at predetermined positions, and guide the chain 64C so that the chain travels along a predetermined path. In the present embodiment, the second sprocket 64B is arranged at a position higher than the first sprocket 64A. For this reason, the traveling path is formed such that the chain 64C inclines on its course. Specifically, the traveling path is constituted of a first horizontal transporting path 70A, an inclined transporting path 70B, and a second horizontal transporting path 70C.

The first horizontal transporting path 70A is set to the same height as the first sprocket 64A, and is set so that the chain 64C wound around the first sprocket 64A travels horizontally. The second horizontal transporting path 70C is set to the same height as the second sprocket 64B, and it is set so that the chain 64C wound around the second sprocket 64B may travel horizontally. The inclined transporting path 70B is set between the first horizontal transporting path 70A and the second horizontal transporting path 70C, and is set so as to connect the first horizontal transporting path 70A and the second horizontal transporting path 70C.

The chain guides are arranged so as to form the first horizontal transporting path 70A, the inclined transporting path 70B, and the second horizontal transporting path 70C. Specifically, the chain guides are arranged at at least a joining point between the first horizontal transporting path 70A and the inclined transporting path 70B, and a joining point between the inclined transporting path 70B and the second horizontal transporting path 70C.

The plurality of grippers 64D are attached to the chain 64C at regular intervals. The attachment intervals of the grippers 64D are set in accordance with the reception intervals of the paper P from the image formation drum 52. That is, the attachment intervals of the grippers 64D are set in accordance with the reception intervals of the paper P from the image formation drum 52 so that the paper P delivered sequentially from the image formation drum 52 can be received from the image formation drum 52 in synchronization.

The chain gripper 64 is configured as described above. As described above, if the motor (not illustrated) connected to the first sprocket 64A is driven, the chain 64C travels. The chain 64C travels at the same speed as the circumferential speed of the image formation drum 52. Timings are matched so that the paper P delivered from the image formation drum 52 can be received by the respective grippers 64D.

The back tension imparting mechanism 66 imparts a back tension (tension) to the paper P transported while the tip of the paper is gripped by the chain gripper 64. The back tension imparting mechanism 66 mainly includes a guide plate 72 serving as a transporting path that is arranged in the heat-drying processing section 20.

The guide plate 72 is constituted of a hollow box plate having a width corresponding to the width of the paper P. Additionally, a large number of suction holes (not illustrated) are formed in an upper surface of the guide plate 72. Moreover, an exhaust pipe for discharging the air suctioned from the large number of suction holes by a suction fan is connected to a lower part side of the guide plate 72.

The guide plate 72 configured as described above is arranged along the transporting path of the paper P by the chain gripper 64, and constitutes the transporting path of the paper P. Specifically, the guide plate is arranged along the chain 64C that travels on the first horizontal transporting path 70A, and is arranged so as to be spaced downward from the chain 64C by a predetermined distance. For this reason, the paper P transported on the outer peripheral side of the chain 64C on the chain gripper 64 is transported while being dragged in a state where a surface opposite to a printed surface is suctioned by the upper surface of the guide plate 72.

The large number of suction holes formed in the upper surface of the guide plate 72 suction a part except the tip part of the paper P gripped by the grippers 64D when the suction fan suctions a hollow part (inside) of the guide plate 72. Accordingly, a back tension (tension) is imparted to the paper P transported by the chain gripper 64.

As described above, since the guide plate 72 is arranged along the chain 64C that travels on the first horizontal transporting path 70A, a back tension is imparted while the paper P is transported on the first horizontal transporting path 70A.

A plurality of drying units 68 arranged along the first horizontal transporting path 70A. In the present embodiment, as an example, four drying units 68 are provided along the first horizontal transporting path 70A. Accordingly, while the paper P passes through the bottoms of the four drying units 68, the drying units 68 blow heated air (warm air) against the paper P, and the paper P is heated and dried.

In addition, the number of drying units 68 installed is set according to the processing capacity of the drying units 68, the transporting speed of the paper P, or the like. That is, the number installed is set so that the paper P received from the image forming section 18 can be dried while being transported on the first horizontal transporting path 70A.

The heat-drying processing section 20 is configured as described above. The paper P delivered from the image formation drum 52 of the image forming section 18 is received by the chain gripper 64. The chain gripper 64 grips the tip part of the paper P with the grippers 64D, lifts the paper from the guide plate 72, and transports the paper P in a state where a rear end of the paper P is brought into contact with the guide plate 72. The paper P delivered to the chain gripper 64 is first transported on the first horizontal transporting path 70A. In the process in which the paper is transported on the first horizontal transporting path 70A, warm air is blown against the paper P from the drying unit 68, and heat-drying processing is performed. In this case, since the paper P is subjected to drying processing while a back tension (tension) is imparted by the back tension imparting mechanism 66, occurrence of uneven drying or creasing can be prevented.

(Ultraviolet Irradiation Processing Section)

The ultraviolet irradiation processing section 22 irradiates the printed surface of the paper P, to which ink has been discharged, with ultraviolet rays as an example of active energy rays, cures ink, and fixes an image. In addition, the active energy rays herein indicate energy rays that may generate a starting seed in an ink composition through the irradiation, and include $\alpha$ rays, $\gamma$ rays, X rays, ultraviolet rays, visible rays, electron beams, or the like. Among these rays, it is preferable to use ultraviolet rays or electron beams from the viewpoints of curing sensitivity and the availability of a device, and ultraviolet rays are more preferable.

The ultraviolet irradiation processing section 22 is constituted of, mainly, a chain gripper 64 that transports the paper P, a back tension imparting mechanism 66 that imparts a back tension to the paper P transported by the chain gripper 64, and an ultraviolet irradiation unit 74 that irradiates the paper P transported by the chain gripper 64 with ultraviolet rays. Additionally, the chain gripper 64 and the back tension imparting mechanism 66 are commonly used by the heat-drying processing section 20.

The ultraviolet irradiation unit 74 is arranged on the inner peripheral side of the chain 64C on the downstream side in the transporting direction from the drying unit 68 so as to face the guide plate 72, and radiates ultraviolet rays to the printed surface of the paper P that passes through the heat-drying processing section 20.

(Cooling Processing Section)

The cooling processing section 23 cools the paper P that has been heated and dried by the heat-drying processing section 20 and has been irradiated with ultraviolet rays by the ultraviolet irradiation processing section 22. The cooling processing section 23 is constituted of, mainly, the chain gripper 64 that transports the paper P that has been irradiated with ultraviolet rays, a supporting plate 82 serving as an example of a transporting surface that supports the paper P transported by the chain gripper 64 and comes into sliding contact with the paper P, and a blower unit 78 that blows air toward the paper P transported by the chain gripper 64.

As described above, the chain gripper 64 is commonly by the heat-drying processing section 20 and the ultraviolet irradiation processing section 22. The supporting plate 82 is arranged along the chain 64C that travels on the first horizontal transporting path 70A and the inclined transporting path 70B.

A plurality of blower unit 78 are arranged to face the supporting plate 82 (transporting surface). In the present embodiment, as an example, two blower units 78 are provided to face the supporting plate 82 arranged on the first horizontal transporting path 70A, three blower units 78 are provided to face the supporting plate 82 arranged on the inclined transporting path 70B, and air is blown against the paper P from each blower unit 78 so as to cool the surface (printed surface) of the paper P. The cooled paper P is transported to the second horizontal transporting path 70C.

(Paper Ejection Section)

The paper ejection section 24 is configured to recover the paper P on which a sequence of image formation processing has been performed. The paper ejection section 24 is configured to include, mainly, the chain gripper 64 that transports the paper P on which ink has been fixed, and a paper ejection stand 76 on which the paper P is stacked and collected. Paper pads (a front paper pad, a rear paper pad, a horizontal paper pad, and the like) for stacking the paper P orderly are provided in the paper ejection stand 76. Additionally, a paper ejection stand ascending and descending device (not illustrated) is provided in the paper ejection stand 76 so as to be liftable. In the paper ejection stand ascending and descending device, driving of ascent and descent is controlled in conjunction with an increase or decrease in the amount of the paper P collected on the paper ejection stand 76, and adjustment is made so that the paper P located on the uppermost position is always located at a constant height.

(Ink)

As the ink to be used in the present embodiment, for example, water-based ultraviolet ink cured by irradiation with ultraviolet rays as radiation is used. It is preferable that a pigment, polymer particles, a water-soluble polymerizable compound polymerized by active energy rays, and a photopolymerization initiator are contained in the water-based ultraviolet ink. In such water-based ultraviolet ink, if the ink is irradiated and cured with ultraviolet rays, the friction resistance of an image is excellent, and the film strength of an image is high. In addition, a dye may be contained as the coloring material.

(Configuration of Liquid Supply Device)

Next, the liquid supply device 11 will be described with reference to FIGS. 2 to 9. As illustrated in FIG. 2, the liquid supply device 11 related to the present embodiment is configured to include, mainly, the circulatory flow passage 80 serving as a flow passage, a filter 84, a concentration meter 86 serving as a concentration detecting device, a heater 88, and a pump 90. The circulatory flow passage 80 is connected to the process liquid tank 44B of the process liquid imparting unit 44, and is configured so as to circulate the process liquid stored in the process liquid tank 44B. Additionally, the circulatory flow passage 80 is provided with the pump 90, and includes a pressurization-side flow passage 80A through which the process liquid flows toward the process liquid tank 44B from the pump 90, and a depressurization-side flow passage 80B through which the process liquid passes through the filter 84, the concentration meter 86, and the heater 88 from the process liquid tank 44B and flows toward the pump 90.

Figure 4:
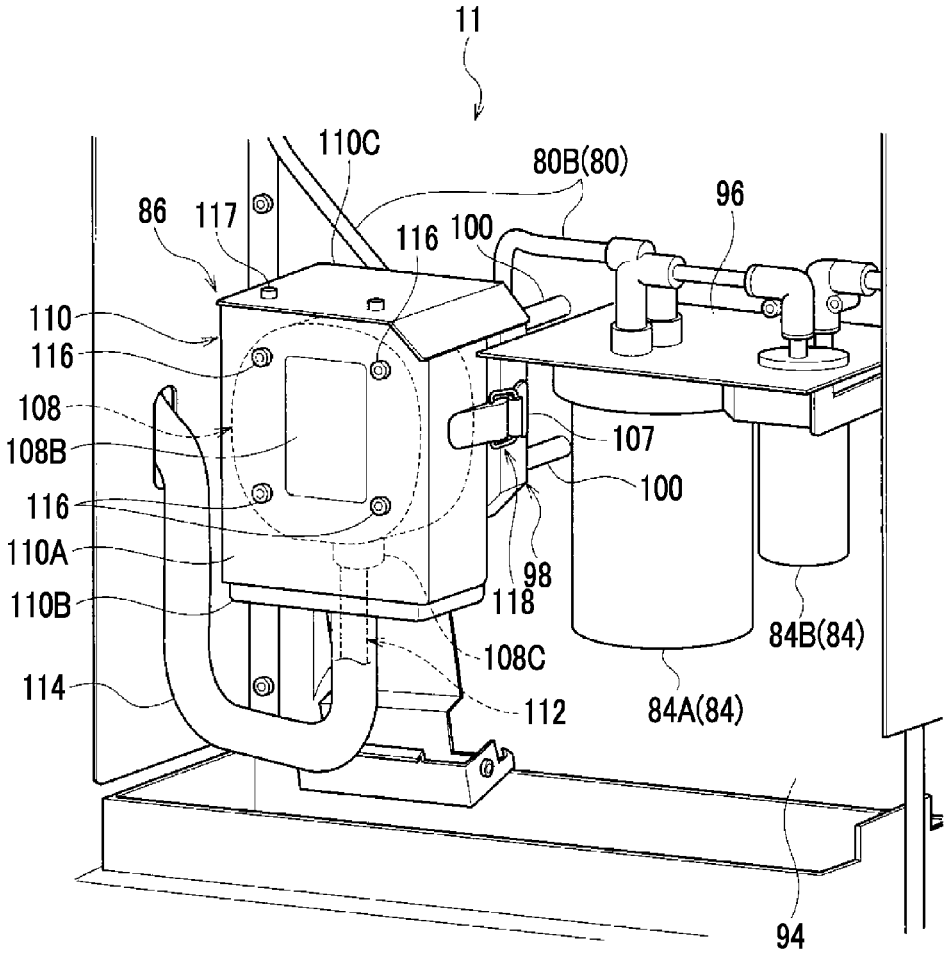
FIG. 4 is a perspective view illustrating main parts of the supply tower of FIG. 3 in an enlarged manner, and is a perspective view illustrating a state where a concentration meter has been closed.

The filter 84 is provided on the downstream side of the process liquid tank 44B in the depressurization-side flow passage 80B, and is configured so that foreign matter in the process liquid can be trapped by the filter 84. In addition, in the present embodiment, as an example, as illustrated in FIG. 4, two filters of a large-sized filter 84A and a small-sized filter 84B are provided. Additionally, a top plate 96 is arranged on a device upper side of the large-sized filter 84A and the small-sized filter 84B, and an upper end of the large-sized filter 84A and an upper end of the small-sized filter 84B are inserted through the top plate 96. Accordingly, when the process liquid has leaked above the large-sized filter 84A and the small-sized filter 84B, the process liquid is received by the top plate 96, and the process liquid is prevented from adhering to the large-sized filter 84A and the small-sized filter 84B.

As illustrated in FIG. 2, the concentration meter 86 is provided on the downstream side of the filter 84, and is configured so that the concentration of the process liquid flowing through the circulatory flow passage 80 can be detected by the concentration meter 86. The details of the concentration meter 86 will be described below.

The heater 88 is provided on the downstream side of the concentration meter 86. A heating flow passage 88A heated by a heat source is provided inside the heater 88, and the circulatory flow passage 80 is connected to one end and the other end of the heating flow passage 88A, respectively. Accordingly, the process liquid that flows through the circulatory flow passage 80 is heated to a predetermined temperature.

The pump 90 is connected to the downstream side of the heater 88, and the process liquid of the depressurization-side flow passage 80B is pushed out to the pressurization-side flow passage 80A by the pump 90. Then, the process liquid pushed out to the pressurization-side flow passage 80A by the pump 90 flows into the process liquid tank 44B.

In addition, in the present embodiment, a thermometer (not illustrated) is provided in the circulatory flow passage 80, and measures the temperature of the process liquid that flows through the inside of the circulatory flow passage 80. Additionally, the thermometer and the heater 88 are electrically connected to the control section (not illustrated), and are configured so as to be capable of adjusting the temperature of the heater 88 according to the temperature of the process liquid measured by the thermometer.

Figure 3:
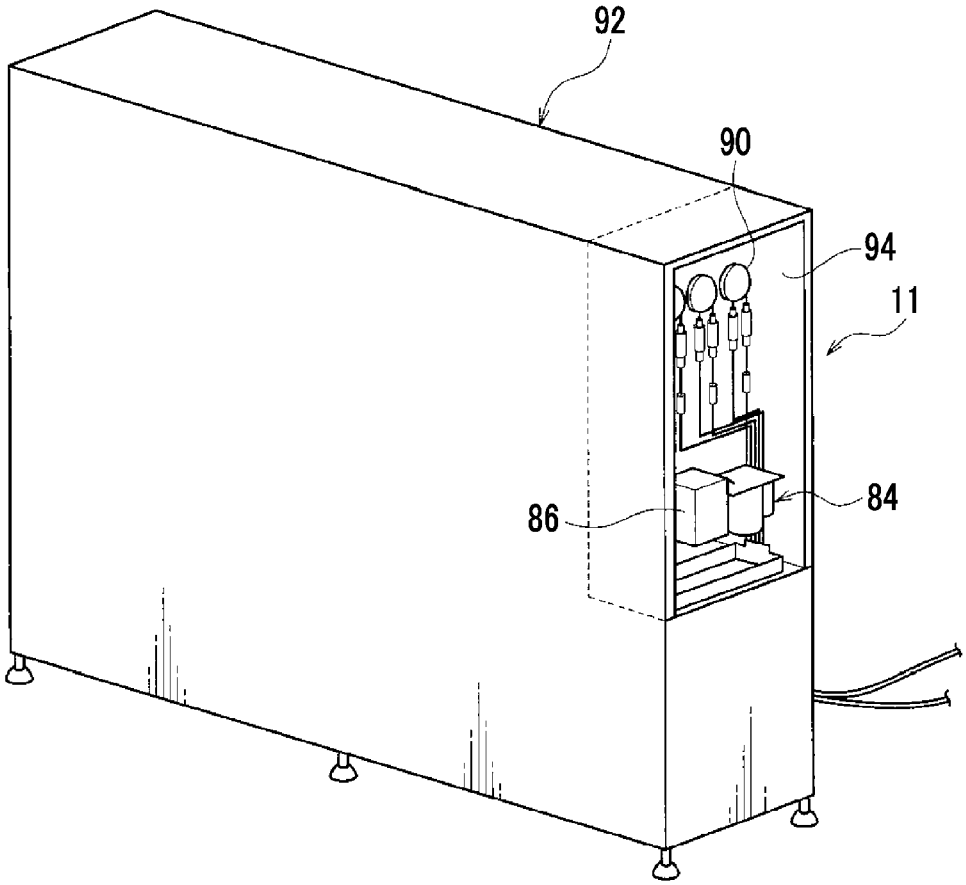
FIG. 3 is a perspective view illustrating a supply tower that constitutes the image forming apparatus related to the embodiment.

Here, as illustrated in FIG. 3, the filter 84, the concentration meter 86, and the pump 90 that constitute the liquid supply device 11 are provided in a supply tower 92. Specifically, the supply tower 92 is a box-shaped unit that is disposed at a position apart from a main body of the image forming apparatus 10, and is connected to the main body of the image forming apparatus 10 via a plurality of cables.

Additionally, the supply tower 92 is provided with a frame member 94. A plurality of pumps including the pump 90 are attached to the frame member 94. Additionally, the filter 84 and the concentration meter 86 are attached to the frame member 94. Accordingly, parts of the filter 84, the concentration meter 86, and the circulatory flow passage 80 are attached to the supply tower 92 in the state of being unitized with the frame member 94. In addition, the plurality of pumps are used for separate applications, respectively, and four pumps are attached as an example in the present embodiment. These pumps are a pump for supplying the process liquid from a tank (not illustrated) to the process liquid tank 44B, a pump for supplying a diluting solution (pure water) to the circulatory flow passage 80, a pump for discarding the process liquid, and the pumps 90 for circulating the process liquid stored in the process liquid tank 44B.

(Attachment Structure of Concentration Meter)

Figure 6:
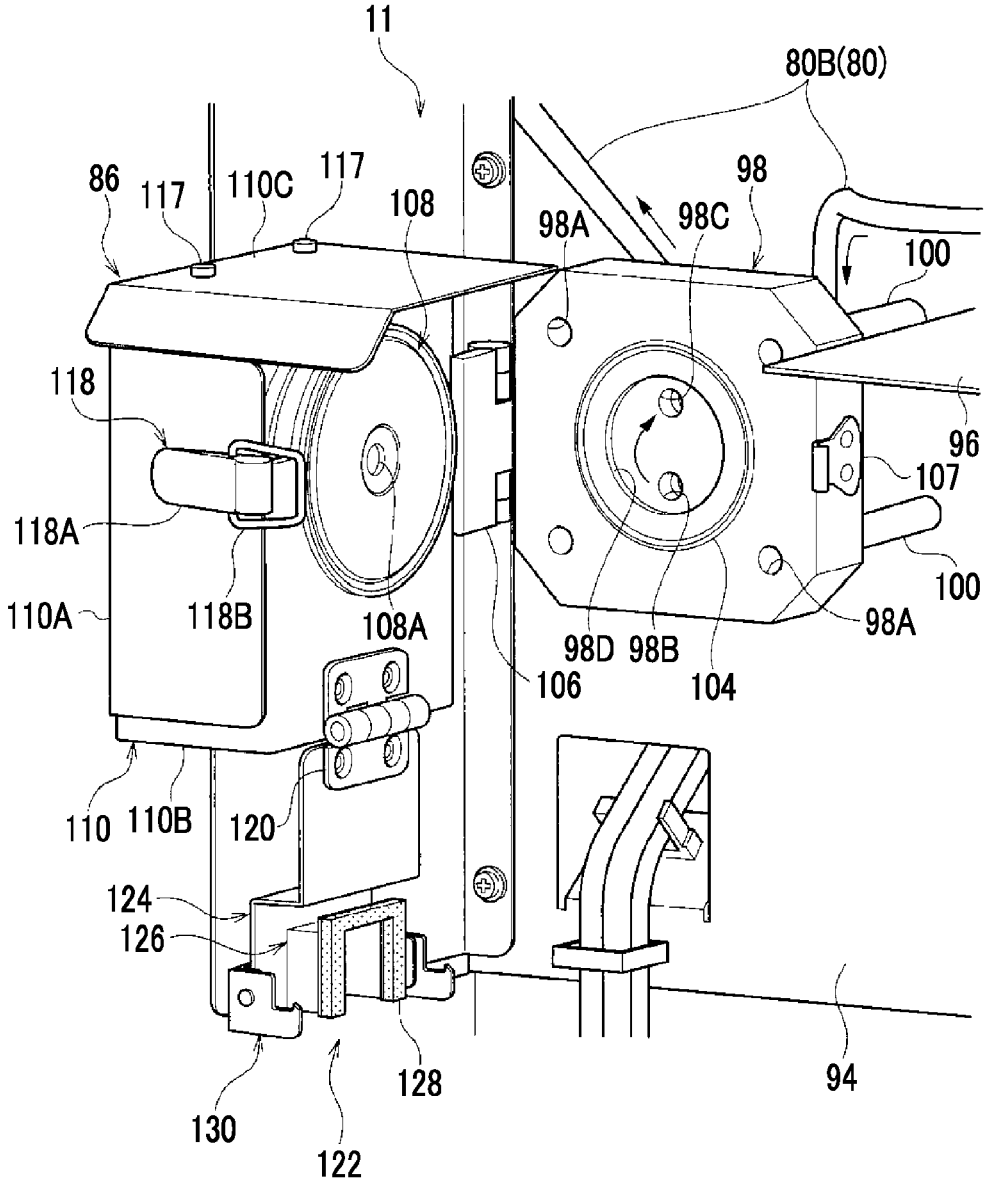
FIG. 6 is a perspective view corresponding to FIG. 4 illustrating a state where the concentration meter has been opened.

As illustrated in FIG. 4, the concentration meter 86 is openably and closably attached to a case 98 that is fixed to the circulatory flow passage 80. Hereinafter, the case 98 and the concentration meter 86 will be described. As illustrated in FIG. 6, the case 98 is a member that is formed in a substantially octagonal shape in a front view, and the four corners on the back side thereof are supported by a plurality of rod bodies 100 that are provided to protrude from the frame member 94. Specifically, the four corners on the back side of the case 98 abut against the four rod bodies 100, and the case 98 is fastened to the frame member 94 via the rod bodies 100 by inserting bolts (not illustrated) into through-holes 98A formed in the four corners of the case 98 and screwing the bolts into the rod bodies 100. Then, the case 98 is attached to and unitized with the frame member 94.

An inlet 98B and an outlet 98C are formed at a central part of the case 98. The inlet 98B passes through the case 98 in the thickness direction, and the circulatory flow passage 80 is connected to the back side of the inlet 98B. Accordingly, the process liquid flowing through the circulatory flow passage 80 is introduced to the front side of the case 98 via the inlet 98B.

Meanwhile, the outlet 98C passes through the case 98 in the thickness direction, and the circulatory flow passage 80 is connected to the back side of the outlet 98C. Accordingly, the process liquid introduced to the front side of the case 98 is led out to the circulatory flow passage 80 via the outlet 98C. Here, a concave part 98D obtained by recessing a region including the inlet 98B and the outlet 98C to the back side is formed on the front side of the case 98. A closed space is formed between the case 98 and the concentration meter 86 by the concave part 98D in the state where the concentration meter 86 has been attached. Accordingly, the process liquid introduced into the front side of the case 98 via the inlet 98B from the circulatory flow passage 80 passes through the closed space between the case 98 and the concentration meter 86, and is led out from the outlet 98C to the circulatory flow passage 80.

Additionally, a groove that is substantially circular in the front view is formed on the front side of the case 98, and this groove is provided with an O ring 104 serving as a case-side seal member. The O ring 104 is provided around the concave part 98D, and a gap between the case 98 and the concentration meter 86 can be sealed by the O ring 104.

Here, a hinge 106 is attached to one side surface of the case 98. The concentration meter 86 is openably and closably coupled to the case 98 via the hinge 106. Additionally, a hook 107 to which a fastener 118 to be described below is hooked is attached to the other side surface of the case 98.

Meanwhile, as illustrated in FIG. 4, the concentration meter 86 is configured to include, mainly, a main body (device body) 108, a power cable 112, and a cover 110. Additionally, the cover 110 is configured to include a front-side cover part 110A that covers the front side of the main body 108, a back-side cover part 110B that covers the back side and a lower surface of the main body 108, and a roof part 110C that covers an upper surface (upper side) of the main body 108.

The main body 108 is covered with the cover 110 except for a portion thereof, and is substantially formed in a columnar shape. Additionally, a lower end of the main body 108 is provided with a connecting part 108C, and the power cable 112 is connected to the connecting part 108C.

Additionally, as illustrated in FIG. 6, the back side of the main body 108 protrudes further to the back side than the back-side cover part 110B, and a central part on the back side in the main body 108 is provided with a detection unit 108A that detects concentration. In addition, in the present embodiment, as an example, the concentration of the process liquid is detected using a refractometer using refraction of light. However, the invention is not limited to this, and concentration meters that detect the concentration of the process liquid according to other principles may be used.

Figure 5:
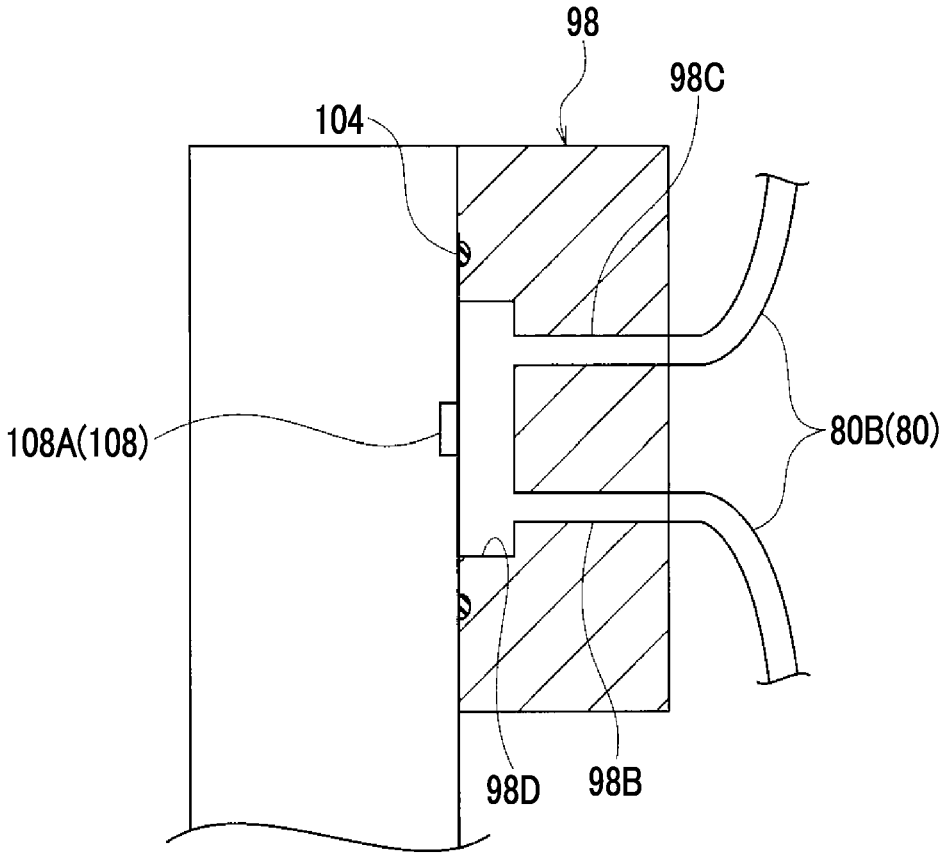
FIG. 5 is a sectional view schematically illustrating an elevational view of the concentration meter and a case in the state of FIG. 4.

Here, as illustrated in FIG. 5, a detection unit 108A of the concentration meter 86 is provided at a position that faces the concave part 98D formed in the case 98 in a case where the concentration meter 86 has been closed to the case 98 side. Hence, the detection unit 108A detects the concentration of the process liquid introduced from the circulatory flow passage 80 via the inlet 98B into the concave part 98D. In addition, as described above, the O ring 104 is provided around the concave part 98D, and the case 98 and the main body 108 are sealed with the O ring 104.

Additionally, as illustrated in FIG. 4, a display unit 108B is provided on the front side of the main body 108. The concentration detected by the detection unit 108A is displayed on the display unit 108B. Additionally, since the display unit 108B is not covered with the front-side cover part 110A, the display unit is configured so that concentration can be viewed from the outside in a state where the cover 110 has been attached.

Next, the cover 110 will be described. The front-side cover part 110A that constitutes the cover 110 is formed in a substantial U-shape that is open to the back side in a cross-sectional shape as viewed from the device upper side, and covers a front surface and both side surfaces of the main body 108. Additionally, four bolts 116 are inserted through the front-side cover part 110A from the front side, and are screwed into the main body 108. Accordingly, the main body 108 and the front-side cover part 110A are fastened.

Moreover, as illustrated in FIG. 6, the hinge 106 is attached to the region of the front-side cover part 110A that covers one side surface of the main body 108. Additionally, the fastener 118 is attached to the region of the front-side cover part 110A that covers the other side surface of the main body 108. The fastener 118 is a so-called catch clip, and includes a claw part 118A and an annular hook part 118B. The fastener 118 and the hook 107 are configured so as to be locked in a state where the concentration meter 86 is brought into close contact with the case 98 by tilting the claw part 118A to the front side of the concentration meter 86 in a state where the hook part 118B has been hooked to the hook 107 attached to the case 98.

The roof part 110C that covers the upper side of the main body 108 is fastened to an upper end of the front-side cover part 110A with bolts 117. Here, the roof part 110C extends further to the back side than the main body 108, and is configured so as to cover an upper part of the case 98 located on the device upper side, in a state where the concentration meter 86 has been closed to the case 98 side (refer to FIG. 4). Additionally, the region of the roof part 110C on the filter 84 side inclines toward a lower side of the main body 108.

The back-side cover part 110B is arranged opposite to the front-side cover part 110A with the main body 108 interposed therebetween. The back-side cover part 110B is formed in a substantial U-shape that is open to the front side in a cross-sectional shape as viewed from the device upper side, and covers a back surface and both the side surfaces of the main body 108. Additionally, the back-side cover part 110B extends further to the lower side than the front-side cover part 110A. A lower end of the back-side cover part 110B is formed in a shape that extends in a horizontal direction and covers the lower surface of the main body 108.

Here, as illustrated in FIG. 4, an insertion hole (not illustrated) is formed in the region of the back-side cover part 110B that covers the lower surface of the main body 108, and the power cable 112 is inserted through this insertion hole. A tip part of the power cable 112 inserted through the insertion hole is connected to the connecting part 108C of the main body 108. For this reason, the connecting part 108C of the main body 108 and the power cable 112 is covered with the cover 110.

The power cable 112 extends from the connecting part 108C to the lower side of the main body 108, and is disposed in a substantial U-shape so as to be bent on the lower side of the main body 108 below the cover 110. Then, the power cable extends to the outer side of the frame member 94, and is connected to a power source (not illustrated).

Additionally, the power cable 112 is covered with a corrugated tube (waved tube) 114 serving as a protecting member. In addition, in FIG. 4, an outer peripheral surface of the corrugated tube 114 is not wavy. However, in practice, the corrugated tube is formed in a waveform in a cross-sectional shape cut along the axial direction. In addition, in the present embodiment, the corrugated tube 114 is fitted to the insertion hole (not illustrated) that is formed in the back-side cover part 110B.

(Structure of Calibration Unit)

As illustrated in FIG. 6, the calibration unit 122 is coupled to the back-side cover part 110B via the hinge 120. Hereinafter, the structure of the calibration unit 122 will be described. In addition, an upward-downward direction in the following description indicates an upward-downward direction in a state where the calibration unit 122 has been mounted on the concentration meter 86. Additionally, a side near the concentration meter 86 in a state where the calibration unit 122 has been set on the concentration meter 86 is described as a near side, and a side away from the concentration meter 86 is described as a far side.

Figure 8:
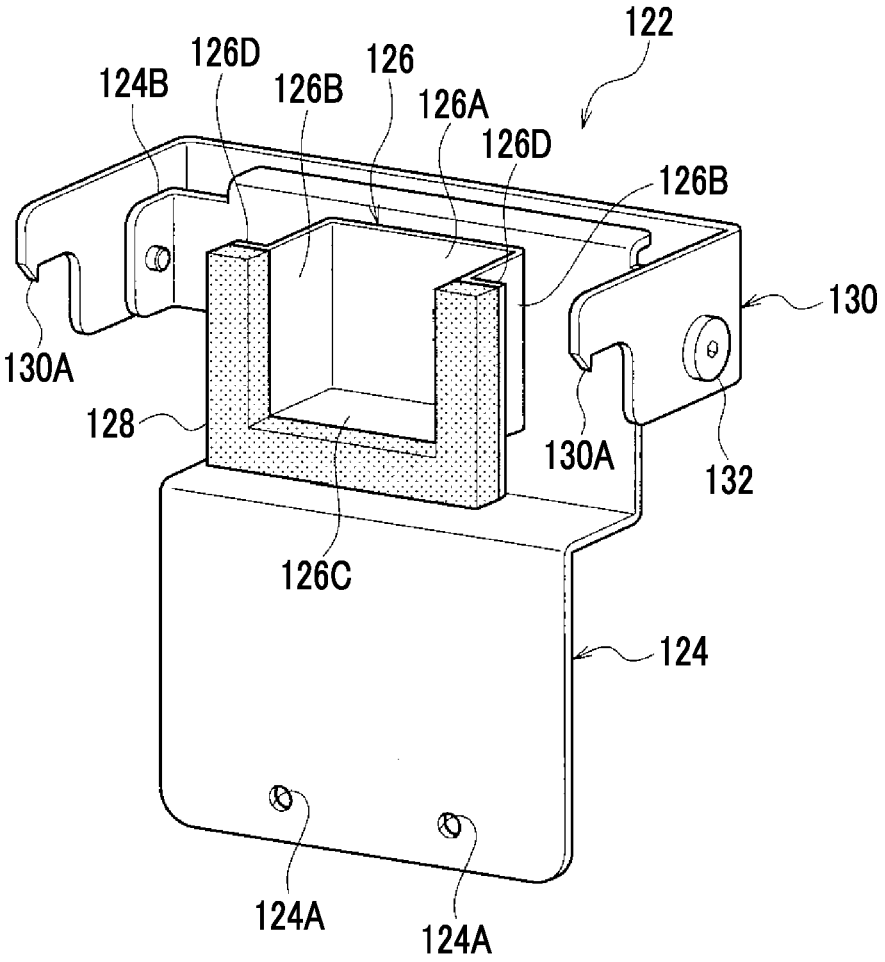
FIG. 8 is a perspective view illustrating the calibration unit of FIG. 7.

As illustrated in FIG. 8, the calibration unit 122 is configured to include, mainly, a base member 124 serving as a liquid tank supporting member, a liquid tank 126 that is attached to the base member 124, and a hook member 130 that is rockably journalled to the base member 124. The base member 124 is a plate material that is formed substantially in a crank shape in a cross-sectional shape, and a lower part of the base member 124 is located on the near side. Additionally, an attachment hole 124A for attaching the hinge 120 is formed at a lower end of the base member 124.

Figure 7:
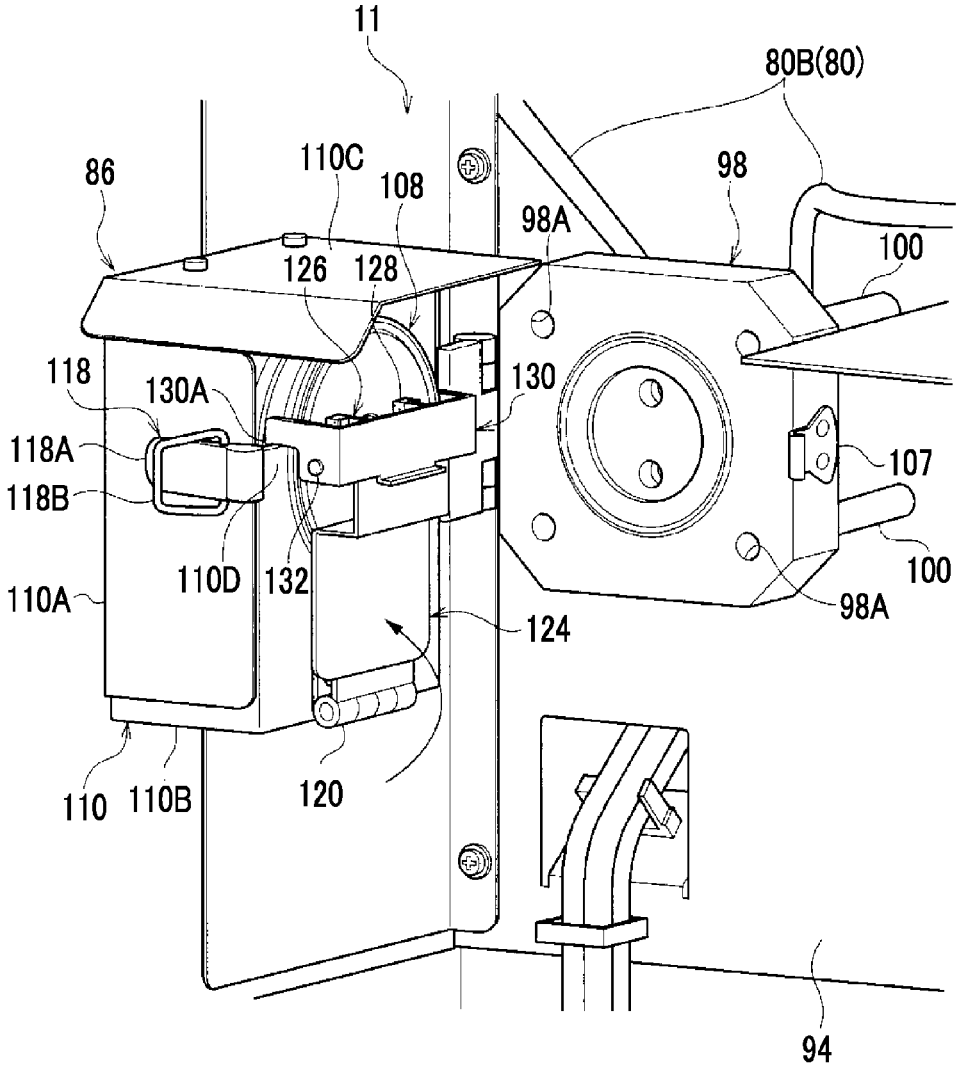
FIG. 7 is a perspective view illustrating a state where a calibration unit has been attached in the state of FIG. 6.

Here, the base member 124 is configured to be movable between a calibration position and a standby position. That is, as illustrated in FIG. 6, the base member is normally arranged at the standby position where the base member has hung down from the back-side cover part 110B via the hinge 120. When the calibration of the concentration meter 86 is performed, as illustrated in FIG. 7, the base member 124 is rocked (moved) upward with the hinge 120 as a center, and is arranged at the calibration position where the base member 124 and the main body 108 face each other.

Additionally, as illustrated in FIG. 8, both ends in the width direction at the upper end of the base member 124 are bent to the near side, and serve as hook attachment parts 124B. Pins 132 are respectively inserted through the hook attachment parts 124B, and the hook member 130 is rockably journalled to the base member 124 via the pins 132. The hook member 130 is formed in a substantial U-shape that is open to the near side in a cross-sectional shape as viewed from above, and both ends thereof in the width direction extend to the near side. A locking claw 130A extends from a tip part of the extending region to the lower side.

Moreover, the liquid tank 126 is attached to a surface of an upper part of the base member 124 on the near side. The liquid tank 126 includes a liquid tank front wall 126A that is formed substantially in a hat shape which is open to the near side in a section as viewed from the device upper side and that is fixed to the base member 124. Additionally a pair of liquid tank side walls 126B extend from both ends of liquid tank front wall 126A in the width direction to the near side, and a lower end of the liquid tank front wall 126A and lower ends of the liquid tank side walls 126B are substantially horizontally coupled to a liquid tank bottom wall 126C. Additionally, flange parts 126D extend from the ends of the pair of liquid tank side walls 126B on the near side to the outer sides in the width direction, respectively, and a flange part (not illustrated) extends downward from the end of the liquid tank bottom wall 126C on the near side. The flange parts 126D on the liquid tank side walls 126B side and the flange part on the liquid tank bottom wall 126C side are connected together, and are formed in a substantial U-shape that opens upward in the front view.

Here, packing 128 serving as a substantially U-shaped liquid-tank-side seal member is attached to the near sides of the flange parts 126D on the liquid tank side walls 126B, and the near side of the flange part of the liquid tank bottom wall 126C side in the front view. The packing 128 is formed of rubber or the like, and is configured so as to be capable of sealing between the liquid tank 126 and the concentration meter 86 when the calibration unit 122 has been mounted on the concentration meter 86.

Figure 9:
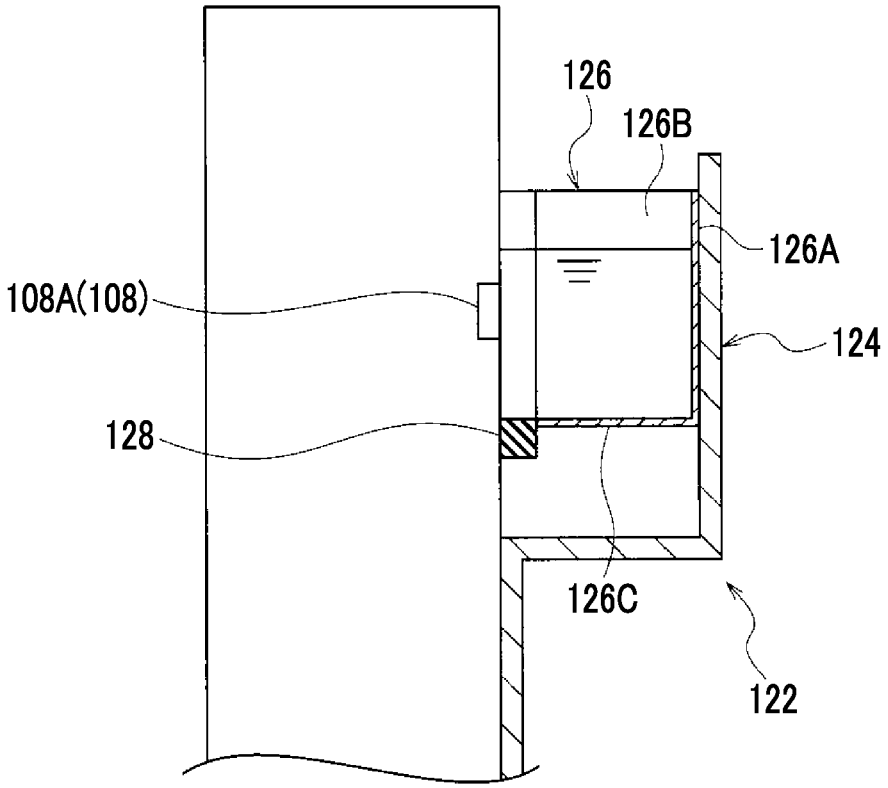
FIG. 9 is a sectional view schematically illustrating an elevational view of the concentration meter and the calibration unit in the state of FIG. 7.

When the calibration unit 122 configured as described above is mounted on the concentration meter 86, as illustrated in FIG. 7, the base member 124 is rocked with the hinge 120 as a center and is moved to the calibration position in a state where the concentration meter 86 is open with respect to the case 98. The hook member 130 is rocked with the pins 132 as a center, and the locking claw 130A is hooked to an upper end (mounting part) 110D of the back-side cover part 110B. Accordingly, as illustrated in FIG. 9, the calibration unit 122 can be mounted on the concentration meter 86 in a state where the packing 128 has been pressed against the main body 108. Here, since a gap between the liquid tank 126 and the main body 108 is sealed, liquid (pure water or the like) for calibration can be stored in the liquid tank 126. Then, in the calibration position, since the detection unit 108A faces the liquid tank 126, the concentration of liquid is detected by the detection unit 108A, and the calibration of the concentration meter 86 is performed.

(Actions and Effects)

Next, actions and effects of the present embodiment will be described. In the liquid supply device 11 that constitutes the process liquid imparting unit 44 of the image forming apparatus 10 related to the present embodiment, a configuration in which the concentration meter 86 is openably and closably attached to the case 98 is adopted. Accordingly, the number of cleaning steps of the concentration meter 86 can be reduced, and maintenance can be improved. That is, in the related art, the concentration meter 86 is fixed. Therefore, in order to clean the detection unit 108A, the case 98 needed to be detached from the concentration meter 86. Here, as illustrated in FIG. 4, it is general to arrange the concentration meter 86 so that the display unit 108B is directed to the outside of the device and the detection unit 108A is directed to the inside of the device. For this reason, a worker had to put his/her hand into the back side of the concentration meter 86 to detach the case 98, which required substantial time and effort. Additionally, since the detection unit 108A of the concentration meter 86 is directed to the inside of the device, it was difficult to perform cleaning while viewing the detection unit 108A.

With respect to the above-described related-art structure, in the liquid supply device 11 related to the present embodiment, when the concentration meter 86 is cleaned, first, the fastener 118 is operated to release the locking state between the fastener 118 and the hook 107, and then, bring the concentration meter 86 into the state of being open with respect to the case 98. Accordingly, as illustrated in FIG. 6, since the detection unit 108A of the concentration meter 86 can be moved to a position that can be viewed by a worker, time and effort taken for the cleaning can be reduced. Additionally, since it is easy to perform work in contrast to a case where the case 98 is detached, the number of cleaning steps can be reduced.

Additionally, in the present embodiment, since the case 98 and the concentration meter 86 are coupled together with the hinge 106, the detection unit 108A can be cleaned without detaching the concentration meter 86 from the case 98. Additionally, in a configuration in which the cleaning is performed by detaching the concentration meter 86 from the case 98, a space for placing the concentration meter 86 is required, whereas such a space becomes unnecessary by openably and closably attaching the concentration meter 86 to the case 98.

Moreover, as illustrated to FIG. 5, in the present embodiment, the case 98 and the main body 108 are sealed with the O ring 104 in state where the concentration meter 86 (main body 108) is closed to the case 98 side. Accordingly, the process liquid introduced from the circulatory flow passage 80 to the concave part 98D can be prevented from leaking from between the case 98 and the main body 108.

Additionally, in the present embodiment, man hours required for calibration can be reduced by using the calibration unit 122. That is, when the calibration of the concentration meter 86 is performed with a structure without the calibration unit 122, first, all the process liquid in the circulatory flow passage 80 is discarded. Then, the circulatory flow passage 80 is filled with liquid for calibration (pure water). Here, in order to pour the process liquid adhering to an inner wall of the circulatory flow passage 80, it is necessary to repeat supply of pure water and liquid waste several times. Thereafter, the calibration is completed by detecting the concentration of the pure water introduced into the case 98 from the circulatory flow passage 80 using the concentration meter 86. Then, image formation is resumed after the pure water is again discarded and the circulatory flow passage 80 is filled with the process liquid after the calibration has been completed.

In contrast to the above-described structure, in the present embodiment, as illustrated in FIG. 7, the calibration can be completed simply by mounting the calibration unit 122 in a state where the concentration meter 86 is open, and filling the liquid tank 126 of the calibration unit 122 with the pure water. Accordingly, the man hours required for the calibration can be reduced, and the amount of the pure water that is used for one calibration can be reduced. Additionally, since it is not necessary to discard the process liquid in the circulatory flow passage 80, costs can be markedly reduced.

Additionally, in the present embodiment, as illustrated in FIG. 6, the concentration meter 86 and the calibration unit 122 are coupled together with the hinge 120. Thus, the calibration unit 122 can be mounted on the concentration meter 86 with simple work. Accordingly, the man hours required for the calibration can be further reduced. Additionally, it is not necessary to secure a space for placing the calibration unit 122 around the concentration meter 86. Moreover, the calibration unit 122 cannot become lost due to being taken out.

Moreover, as illustrated in FIG. 8, since the packing 128 is provided in the liquid tank 126 of the calibration unit 122, the liquid stored in the liquid tank 126 can be prevented from leaking in a state where the calibration unit 122 is mounted on the concentration meter 86 (main body 108) as illustrated in FIG. 9.

Additionally, as illustrated in FIG. 4, the concentration meter 86 is provided with the roof part 110C, and the upper side of the detection unit 108A and the upper side of the case 98 are covered with the roof part 110C. Accordingly, even in a case where liquid, such as the process liquid, has leaked above the concentration meter 86, this liquid can be prevented from adhering to the detection unit 108A or the case 98. Particularly, even in a case where a strongly-acidic liquid is used as the process liquid, the case 98 can be protected by the roof part 110C. Therefore, it is also possible to form the case 98 from a material, such as resin, which is not acid-resistant. Excellent detection accuracy of the concentration meter 86 can be maintained by protecting the detection unit 108A from the process liquid in this way.

Moreover, in the present embodiment, as illustrated in FIG. 4, the connecting part 108C between the main body 108 of the concentration meter 86 and the power cable 112 is covered with the cover 110. Accordingly, even in a case where liquid, such as the process liquid, which flows through the circulatory flow passage 80, has leaked, the liquid can be prevented from adhering to the connecting part 108C. Additionally, by covering the power cable 112 with the corrugated tube 114, the power cable 112 can be protected from strongly-acidic process liquid. Moreover, the power cable 112 and the corrugated tube 114 are bent below the cover 110, and are disposed in a substantial U-shape. Accordingly, by pouring the process liquid to the lower side of the main body 108 below the cover 110 through the corrugated tube 114, even if the process liquid has adhered to the surface of the corrugated tube 114, the process liquid can be effectively prevented from adhering to the connecting part 108C.

Additionally, in the present embodiment, since the case 98, the concentration meter 86, and a portion of the circulatory flow passage 80 are attached to and unitized with the frame member 94, the assembling workability of the case 98 and the circulatory flow passage 80 can be improved. Additionally, respective fixtures can be assembled to the supply tower 92 or the like after being attached to the frame member 94.

Moreover, since the case 98 is structured to be supported by the four rod bodies 100 provided to protrude from the frame member 94, the circulatory flow passage 80 can be disposed in the space between the frame member 94 and the case 98.

Although the invention has been described above using the above embodiment, the invention is not limited to the above embodiment, and can be variously changed without departing from the concept thereof. For example, in the present embodiment, the liquid supply device 11 has been applied to the process liquid imparting unit 44 that imparts the process liquid. However, the invention is not limited to this, and may be applied to devices that supply other liquids as long as the devices are liquid supply devices that supply liquids for imparting to paper. For example, the invention may be applied to a supply device that supplies ink.

Additionally, in the present embodiment, the concentration meter 86 is openably and closably attached to the case 98. However, the invention is not limited to this. For example, the concentration meter 86 may be detachably attached to the case 98. As an example of this, a configuration may be adopted in which a guide rail is attached to the case 98 side and the concentration meter 86 is made to slide along the guide rail so as to be capable of being attached and detached.

Moreover, in the present embodiment, the concentration meter 86 is openably and closably attached to the case 98 with one hinge 106. However, the invention is not limited to this, and two or more hinges 106 may be used. Additionally, in the present embodiment, the concentration meter 86 and the calibration unit 122 are coupled together with the hinge 120. However, the invention is not limited to this, and a configuration may be adopted in which the calibration unit 122 can be attached and detached. However, it is more preferable to perform the coupling with the hinge 120 from the viewpoint that the calibration unit 122 can be mounted with simple work as described work.

Additionally, in the present embodiment, the power cable 112 of the concentration meter 86 is covered with the corrugated tube 114. However, the invention is not limited to this, and the power cable may be covered with other protecting members. For example, the power cable 112 may be covered with a protective tube having no irregularities on the surface thereof.

What is claimed is:

1. A liquid supply device comprising:

a flow passage through which liquid for being imparted to paper flows;

a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case, wherein the concentration detecting device is provided with a mounting part for mounting a liquid tank for storing liquid for calibration, at a position that faces the detection unit, wherein a liquid tank supporting member, which is movable between a calibration position and a standby position, is attached to the concentration detecting device, and wherein the liquid tank is attached to the liquid tank supporting member and faces the detection unit at the calibration position.

2. The liquid supply device according to claim 1, wherein the liquid tank is provided with a liquid-tank-side seal member that seals between the liquid tank and the concentration detecting device.

3. The liquid supply device according to claim 1, wherein the concentration detecting device is openably and closably coupled to the case with a hinge, and wherein the concentration detecting device is provided with a mounting part for mounting a liquid tank for storing liquid for calibration, at a position that faces the detection unit.

4. The liquid supply device according to claim 3, wherein the liquid tank is provided with a liquid-tank-side seal member that seals between the liquid tank and the concentration detecting device.

5. A liquid supply device comprising:

a flow passage through which liquid for being imparted to paper flows;

a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case, wherein the concentration detecting device is provided with a mounting part for mounting a liquid tank for storing liquid for calibration, at a position that faces the detection unit, and wherein the liquid tank is provided with a liquid-tank-side seal member that seals between the liquid tank and the concentration detecting device.

6. The liquid supply device according to claim 5, wherein the concentration detecting device is openably and closably coupled to the case with a hinge, and wherein the concentration detecting device is provided with a mounting part for mounting a liquid tank for storing liquid for calibration, at a position that faces the detection unit.

7. A liquid supply device comprising:

a flow passage through which liquid for being imparted to paper flows;

a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case, wherein the concentration detecting device is provided with a mounting part for mounting a liquid tank for storing liquid for calibration, at a position that faces the detection unit, and wherein the case is provided with a case-side seal member that seals between the case and the concentration detecting device.

8. The liquid supply device according to claim 7, wherein the concentration detecting device is openably and closably coupled to the case with a hinge.

9. A liquid supply device comprising:

a flow passage through which liquid for being imparted to paper flows;

a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case, wherein the concentration detecting device is provided with a mounting part for mounting a liquid tank for storing liquid for calibration, at a position that faces the detection unit, and wherein the concentration detecting device is provided with a roof part that covers at least a upper side of the detection unit.

10. The liquid supply device according to claim 9, wherein the roof part extends to a position where an upper part of the case is covered in a state where the concentration detecting device is attached to the case.

11. A liquid supply device comprising:

a flow passage through which liquid for being imparted to paper flows;

a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case, wherein the concentration detecting device is provided with a mounting part for mounting a liquid tank for storing liquid for calibration, at a position that faces the detection unit, and wherein the concentration detecting device includes a device body, a power cable that is connected to the device body, and a cover that covers a connecting part between the device body and the power cable.

12. The liquid supply device according to claim 11, wherein the power cable is covered with a protecting member.

13. The liquid supply device according to claim 11, wherein the power cable extends from the connecting part to a lower side of the device body, and is disposed in a substantial U-shape so as to be bent on the lower side below the cover.

14. A liquid supply device comprising:

a flow passage through which liquid for being imparted to paper flows;

a case including an inlet that is fixed to the flow passage and introduces the liquid from the flow passage, and an outlet that leads the liquid out to the flow passage; and a concentration detecting device that is openably and closably or attachably and detachably attached to the case and includes a detection unit, which detects the concentration of the liquid, at a position that faces the case, wherein the concentration detecting device is provided with a mounting part for mounting a liquid tank for storing liquid for calibration, at a position that faces the detection unit, wherein the case is attached to and unitized with a frame member, and wherein the case is supported by a plurality of rod bodies provided to protrude from the frame member.

* * * * *